US010584486B2

(12) United States Patent
Lucas

(10) Patent No.: US 10,584,486 B2
(45) Date of Patent: Mar. 10, 2020

(54) OUTER BUILDING CONSTRUCTION

(71) Applicant: Grand Siding, LLC, Wyoming, MI (US)

(72) Inventor: Roger Lucas, Wyoming, MI (US)

(73) Assignee: Grand Siding, LLC, Wyoming, MI (US)

( * ) Notice: Subject to any disclaimer, the term of this patent is extended or adjusted under 35 U.S.C. 154(b) by 0 days.

(21) Appl. No.: 15/463,114

(22) Filed: Mar. 20, 2017

(65) Prior Publication Data

US 2018/0266097 A1 Sep. 20, 2018

(51) Int. Cl.

| | |
|---|---|
| ***E04B 1/04*** | (2006.01) |
| ***E04B 5/02*** | (2006.01) |
| *E04B 1/76* | (2006.01) |
| *E04B 5/10* | (2006.01) |

(52) U.S. Cl.

CPC ..... *E04B 5/023* (2013.01); *E04B 1/04* (2013.01); *E04B 1/7675* (2013.01); *E04B 5/10* (2013.01)

(58) Field of Classification Search

None

See application file for complete search history.

(56) References Cited

U.S. PATENT DOCUMENTS 1,727,117 A * 9/1929 Slidell ..... E04B 2/56 52/272
1,779,713 A * 10/1930 Satterlee ..... E04B 2/58 52/236.6
1,973,741 A * 9/1934 Bauer ..... E04B 1/185 52/651.07
2,295,834 A * 9/1942 Drew ..... E04B 2/56 52/274
2,592,634 A * 4/1952 Wilson ..... E04B 1/04 52/125.5
2,607,450 A * 8/1952 Horowitz ..... E04B 1/2403 403/217
3,439,601 A * 4/1969 Cooper ..... F24F 7/06 165/54
3,735,544 A * 5/1973 Longinotti ..... E04B 1/08 52/235
3,736,709 A * 6/1973 Koch ..... E04B 1/04 52/223.7
3,936,986 A * 2/1976 Steel ..... E04B 2/94 52/235
4,461,130 A * 7/1984 Shubow ..... E04B 1/20 52/236.6
4,669,240 A * 6/1987 Amormino ..... E04B 1/04 264/253
4,918,897 A * 4/1990 Luedtke ..... E04B 1/16 52/291
5,048,257 A * 9/1991 Luedtke ..... E04B 1/16 52/364
5,154,029 A * 10/1992 Sturgeon ..... E04F 13/12 52/235
5,727,358 A * 3/1998 Hayashi ..... E04B 1/21 403/171

(Continued)

*Primary Examiner* — Kyle J. Walraed-Sullivan

(74) *Attorney, Agent, or Firm* — The Watson IP Group, PLC; Jovan N. Jovanovic

(57) ABSTRACT

A wall assembly configured for attachment to a floor and a ceiling, the wall assembly having a concrete body, a floor coupling and a ceiling coupling. The concrete body is a precast concrete having an outer shell defined in a lower end and an upper end. The floor coupling is positioned proximate the lower end of the outer shell. The ceiling coupling positioned proximate the upper end of the outer shell.

14 Claims, 5 Drawing Sheets

(56) References Cited

U.S. PATENT DOCUMENTS 7,900,410 B2 * 3/2011 Skendzic ..... E04B 1/04 52/236.5
9,617,724 B2 * 4/2017 Lubberts ..... E04B 1/043
2003/0230032 A1 * 12/2003 Shahnazarian ..... E04H 9/14 52/167.3
2004/0074161 A1 * 4/2004 Kasai ..... E04H 9/02 52/167.1
2004/0177574 A1 * 9/2004 Wallin ..... E04B 1/20 52/252
2005/0284095 A1 * 12/2005 Switzer ..... B28B 7/0032 52/782.1
2006/0016133 A1 * 1/2006 Speck ..... E04B 2/90 52/79.1
2006/0137269 A1 * 6/2006 Di Lorenzo ..... B28B 7/007 52/250
2006/0185290 A1 * 8/2006 DiLorenzo ..... E01F 8/0029 52/414
2008/0127601 A1 * 6/2008 Schiffmann ..... B29C 70/443 52/741.1
2010/0257805 A1 * 10/2010 Di Lorenzo ..... E04B 1/043 52/477
2011/0030288 A1 * 2/2011 Traulsen ..... E04B 1/04 52/126.1
2011/0131908 A1 * 6/2011 Lee ..... E04B 1/04 52/283
2011/0225914 A1 * 9/2011 Molfetta ..... E04B 1/161 52/309.1
2014/0090315 A1 * 4/2014 Imai ..... E04B 1/49 52/167.1
2014/0215956 A1 * 8/2014 Smith ..... E04B 1/003 52/705
2014/0223851 A1 * 8/2014 Vanderydt ..... E04C 2/06 52/578
2014/0260039 A1 * 9/2014 Schwartau ..... E04B 1/14 52/483.1
2015/0089891 A1 * 4/2015 Schiffmann ..... E02D 27/013 52/309.1
2015/0275499 A1 * 10/2015 Lubberts ..... E04B 1/043 52/281
2017/0175408 A1 * 6/2017 Lubberts ..... E04G 21/147

* cited by examiner

OUTER BUILDING CONSTRUCTION

CROSS-REFERENCE TO RELATED APPLICATION

N/A

BACKGROUND OF THE DISCLOSURE

1. Field of the Disclosure

The disclosure relates in general to the construction of buildings and the like, and more particularly, to a building construction which is well suited to form the outside of a building in a multi-story structure. It will be understood that the disclosure is not limited to use on multi-story structures, or a building of any particular height. It will further be understood that the disclosure is not limited to use on the outside of a building (internal use may be contemplated).

2. Background Art

In building construction, especially with multistory buildings, the construction of the outer walls is particularly costly and challenging. This is increasingly the case with buildings as such buildings become taller. In many instances, the cost includes the construction of a stud wall at an elevated height. Once formed, it is necessary to apply some type of outer covering (such as a plywood sheeting, for example, or other board-like material) and then a finishing covering, such as a cladding, siding (i.e., wood or vinyl, etc.). Next, it is necessary to apply an insulation to the inside of the outer covering, and in many instances, further house wraps, sealing films or the like need to be applied as vapor barriers and the like.

Problematically, these outer structures become increasingly complex and increasingly more challenging as the height of the building grows. It is more difficult to install outer claddings on the fifteenth story than it is to do the same on the second story, for example.

Precast concrete walls are known in the art. One such wall is manufactured by Superior Walls of New Holland, Pa., and described below. Such a wall is commonly utilized in one and two story structures, and many times for basements or below grade construction. Such walls are typically stackable to a height of two or three (maybe even a few, in some applications) levels. However, as such walls are stacked, the walls are limited for use in structures that are relatively short and have very few stories.

SUMMARY OF THE DISCLOSURE

The disclosure is directed, in a first aspect, to a building construction comprising a floor, a ceiling and a wall assembly. The floor includes an upper surface and an outer surface. One of these surfaces has a floor coupling member positioned thereon. The ceiling has a lower surface and an outer surface. One of these surfaces has a ceiling coupling member positioned thereon. The wall assembly includes a concrete body, a floor coupling and a ceiling coupling. The concrete body has a footer beam, an outer shell and an upper bond beam. The concrete body is structured from a precast concrete member. The floor coupling is positioned on the footer beam or a lower end of the outer shell. The ceiling coupling is positioned on the upper bond seam or an upper end of the outer shell. The floor coupling of the concrete body is attached to the floor coupling member of the floor, and wherein the ceiling coupling of the concrete body is attached to the ceiling coupling member of the ceiling, to, in turn, attach the wall assembly to the floor and the ceiling.

In some configurations, the floor coupling member comprises at least one metal member that is coupled to the floor.

In some configurations, the ceiling coupling member comprises at least one metal member that is coupled to the floor.

In some configurations, the floor coupling of the concrete body and the ceiling coupling of the concrete body comprise at least one metal member corresponding, respectively, to the floor coupling member and the ceiling coupling member.

In some configurations, the at least one metal member of the floor coupling and the at least one metal member of the floor are welded together. Additionally, the at least one metal member of the ceiling coupling and the at least one metal member of the ceiling are welded together.

In some configurations, the concrete body further includes a plurality of inner studs extending from at least one of the outer shell, the footer beam and the upper bond beam. And the inner studs are spaced apart from each other.

In some configurations, the studs span between the outer shell, the footer beam and the upper bond beam and further include an inner stud facing formed coupled thereto.

In some configurations, the inner stud facing comprises a metal member that is coupled to the concrete body, and extending therefrom.

In some configurations, the at least one metal member of the floor coupling extends from the concrete body. Additionally, the at least one metal member of the ceiling coupling extends from the concrete body. The concrete body is molded therearound.

In some configurations, the at least one metal member of the floor coupling comprises at least two spaced apart metal members. The at least one metal member of the ceiling coupling comprises at least two spaced apart member.

In some configurations, the floor coupling member extends from the upper surface of the floor.

In some configurations, the ceiling coupling member extends from the lower surface of the ceiling.

In some configurations, the wall assembly further includes a plurality of openings defined in the outer shell of the concrete body, and further includes an opening framing coupled to the concrete body.

In some configurations, the concrete body further includes an overhanging portion on an outer side of the outer shell that extends into the opening framing, so as to change an outward appearance of the opening, rendering the same different from a configuration of the opening framing.

In another aspect of the disclosure, the disclosure is directed to a wall assembly configured for attachment to a floor and a ceiling. The wall assembly comprises a concrete body, a floor coupling and a ceiling coupling. The concrete body is a precast concrete having an outer shell defined in a lower end and an upper end. The floor coupling is positioned proximate the lower end of the outer shell. The ceiling coupling positioned proximate the upper end of the outer shell.

In some configurations, the concrete body further includes at least one of a footer beam and an upper bond beam extending from the outer shell.

In some configurations, the outer shell may include a fascia region that extends beyond one of the footer beam and the upper bond beam.

In some configurations, the floor coupling comprises a plurality of spaced apart metal members extending from the concrete body, and the ceiling coupling comprises a plurality of spaced apart metal members extending from the concrete body.

In some configurations, the floor coupling extends from the footer beam and wherein the ceiling coupling extends from the upper bond beam.

In some configurations, the outer shell further includes an opening defined therein, with an opening framing extending therearound. A portion of the outer shell extends over and beyond the opening framing to define an overhang.

BRIEF DESCRIPTION OF THE DRAWINGS

The disclosure will now be described with reference to the drawings wherein.

DETAILED DESCRIPTION OF THE DISCLOSURE

Figure 1:
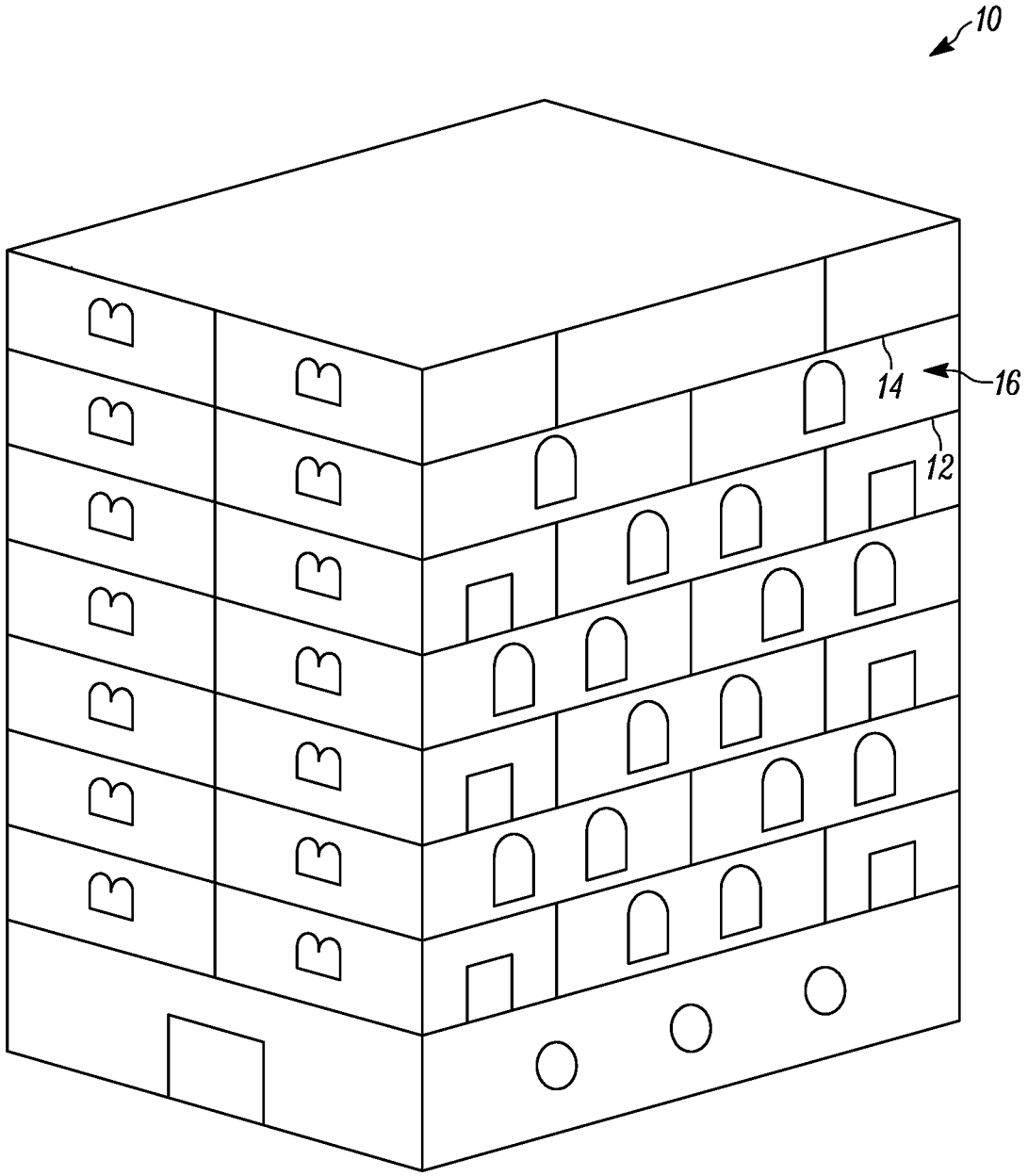
FIG. 1 of the drawings is a perspective view of the outer building construction.
Figure 2:
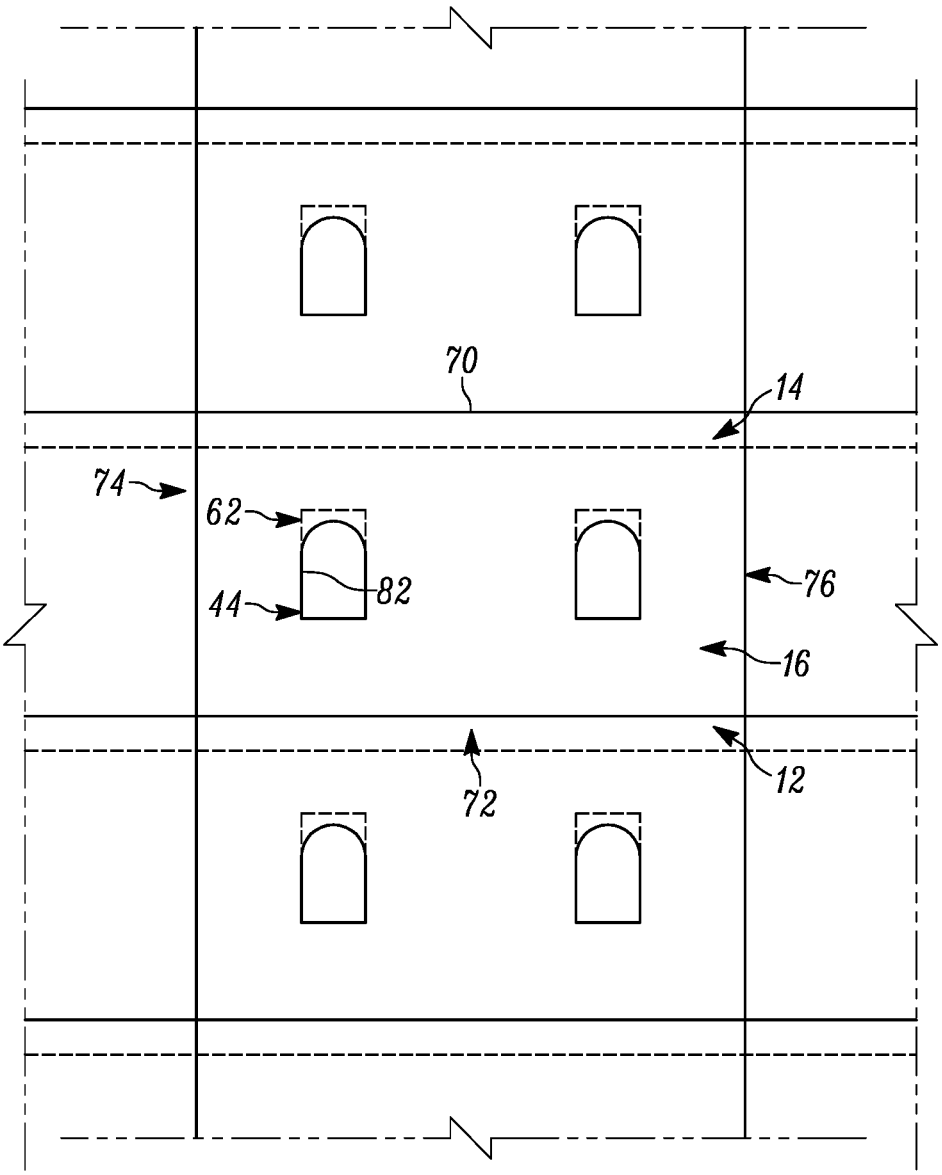
FIG. 2 of the drawings is a partial side elevational view of the outer building construction.
Figure 3:
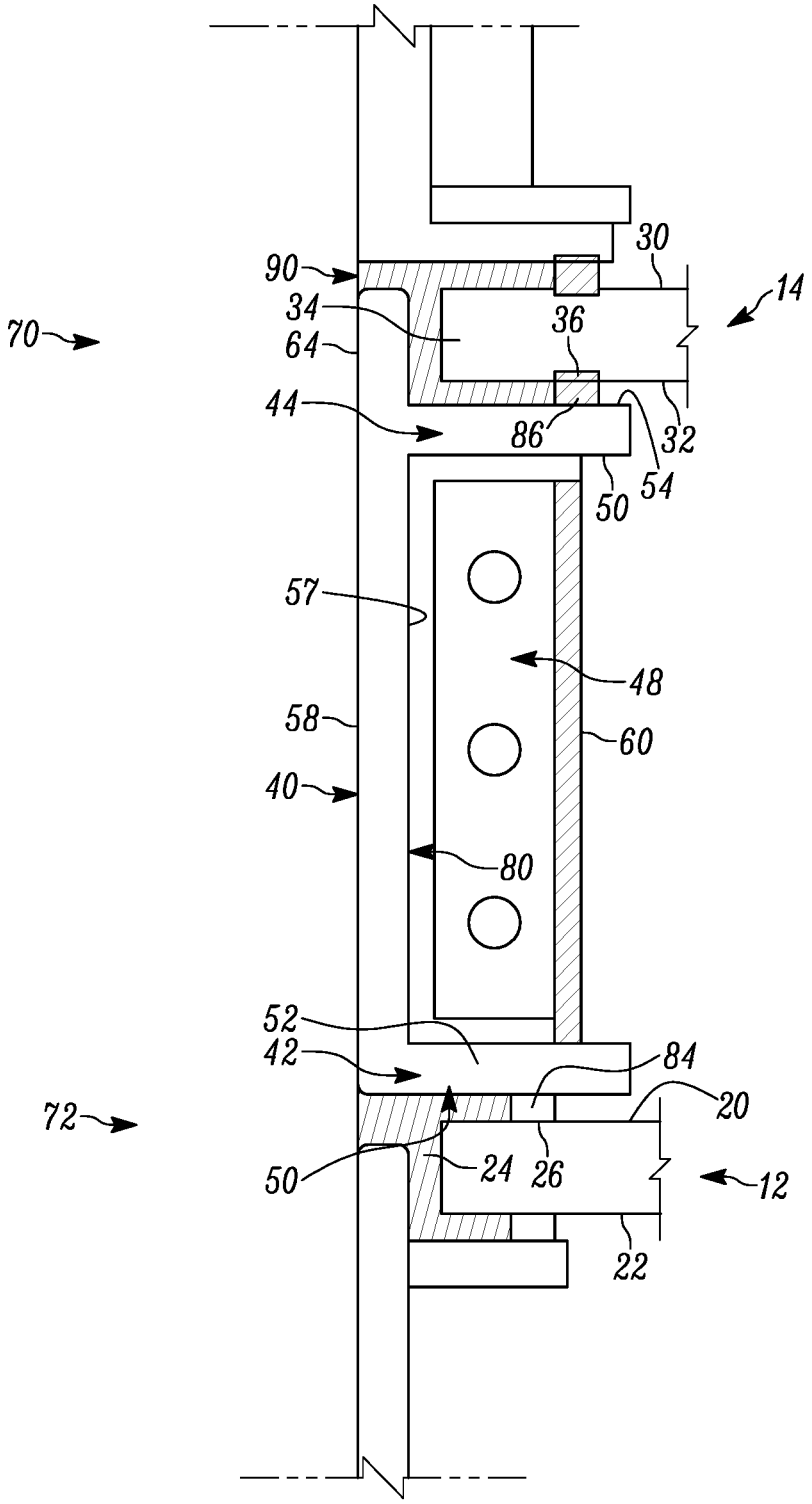
FIG. 3 of the drawings is a partial cross-sectional view of the outer building construction.
Figure 4:
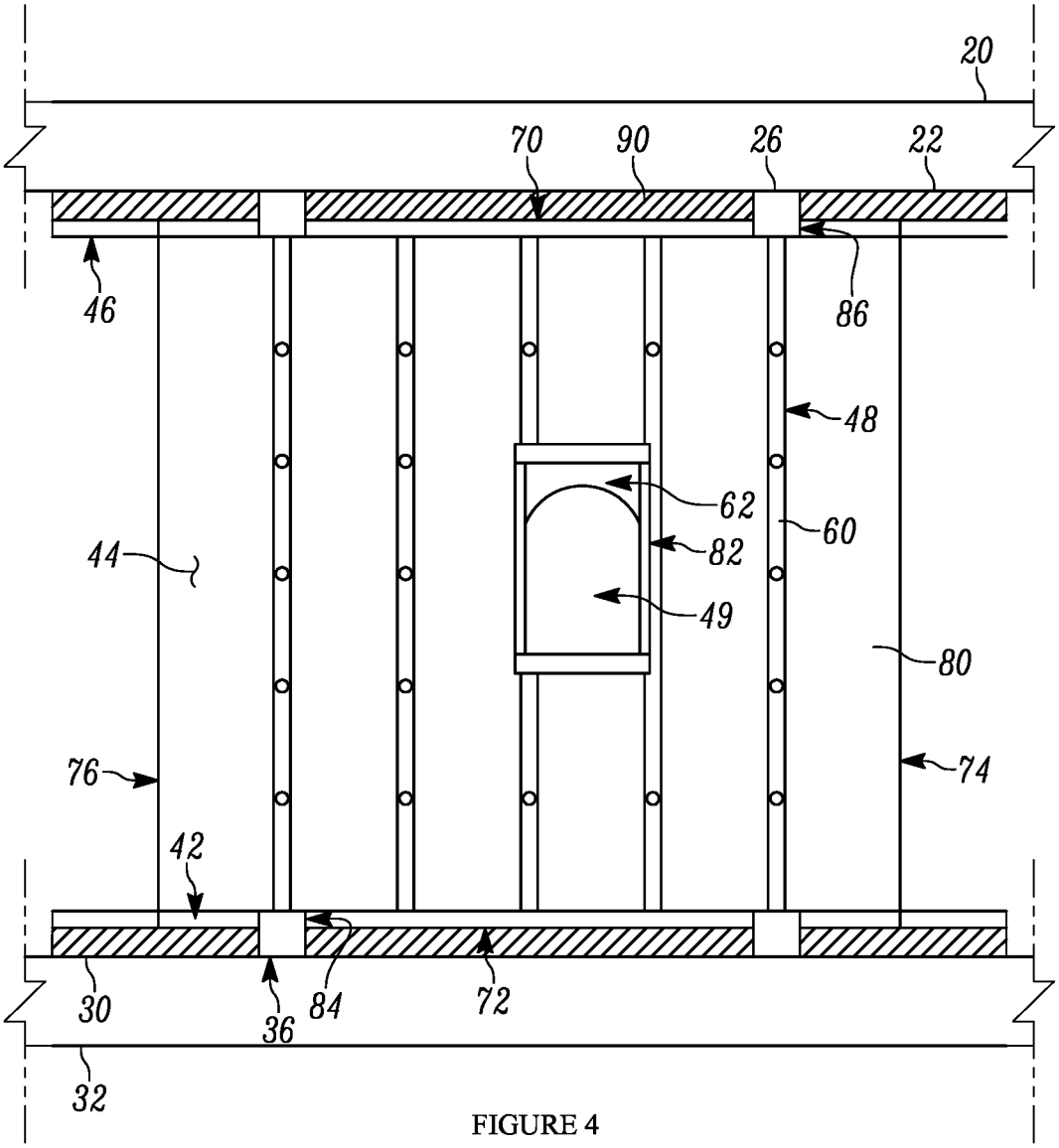
FIG. 4 of the drawings is a partial side elevational view of the inside of the outer building construction.
Figure 5:
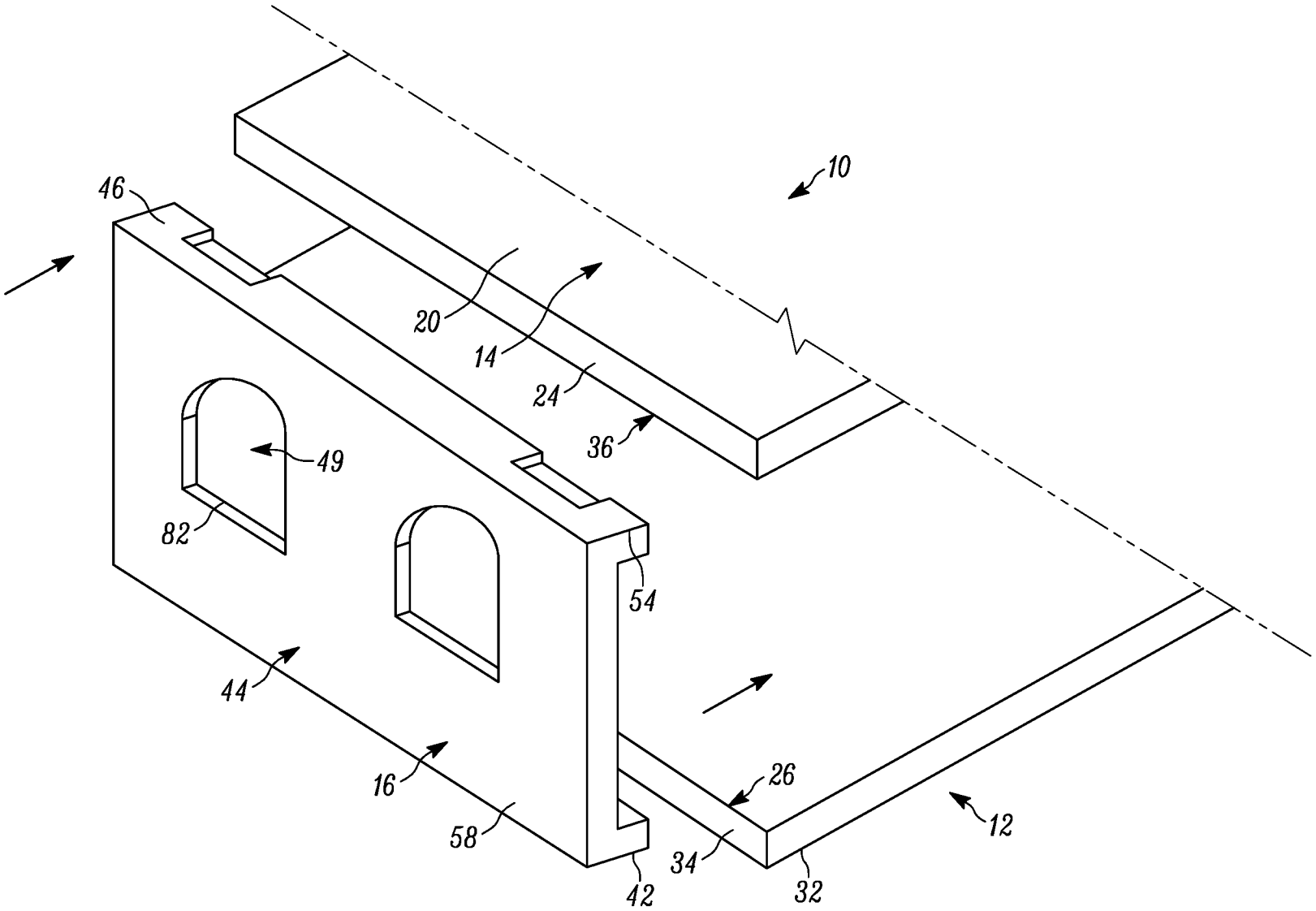
FIG. 5 of the drawings is a partial perspective view of the outer building construction.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the outer building construction is shown generally at 10. It will be understood that the outer building construction provides an outer covering or skin to the building, integrally with insulation, studs and window/door framing. It will be understood, for example, that such a construction can be used on low rise, mid rise and high rise buildings. The construction is not limited to any particular building type, and can be utilized wherein the framing of the building (that is the floors, ceilings and inner supports) may be formed from reinforced concrete, steel girders or combinations of the same.

In the configuration shown, the outer building construction will be described in an environment wherein the floor and the ceiling are formed from a reinforced concrete. Again, the disclosure is not limited to use in association with such a building construction. With reference to FIG. 1, the floor 12 is shown as having an upper surface 20, a lower surface 22 and an outer surface 24. Typically the upper and lower surfaces are substantially planar and parallel to each other with the outer surface 24 being substantially perpendicular to each and outwardly facing. At least one floor coupling member 26 is disposed on one of the upper surface 20, lower surface 22 and outer surface 24. In the configuration shown, multiple floor coupling members are disposed on the upper surface 20 of the floor 12 spaced inwardly from the outer surface 24.

The ceiling 14 is shown as having an upper surface 30, lower surface 32 and outer surface 34. As with the floor, the upper and lower surfaces of the ceiling are substantially planar and parallel to each other, with the outer surface 34 being substantially perpendicular to each and outwardly facing. At least one ceiling coupling member is disposed on one of the upper surface 30, lower surface 32 and outer surface 34. In the configuration shown, multiple ceiling coupling member 36 are disposed on the lower surface 32 of the ceiling 14 spaced inwardly from the outer surface 34.

It will be understood that while a single story is shown, the configuration may comprise multiple stories. In the case of multiple stories, it is contemplated that the ceiling of a first story may similarly comprise the floor of the immediately adjacent story. This can be repeated for each story. In such multi-story configurations, many of the structures will comprise both a floor and a ceiling (i.e., a floor for one level and a ceiling for an adjacent level). As such, the upper surface or outer surface will include a floor coupling member, and the lower surface or the outer surface will include a ceiling coupling member. It will be understood that the different stories may extend outwardly to a different extent, and that the wall assembly can overcome these variations in the configuration of the different wall structures.

With reference to FIG. 1, the wall assembly 16 is coupled to each of the floor and the ceiling. The wall assembly comprises concrete body 40, insulation 80, opening framing 82, floor coupling 84 and ceiling coupling 86. Generally, the wall assembly comprises a complete wall structure that is ready to accept additional insulation, electrical lines and plumbing, and a finishing inner wall covering (such as, for example, drywall or the like). One such wall assembly (without the floor coupling and ceiling coupling), comprises the XI Wall that is a precast concrete stackable wall available from Superior Walls of New Holland, Pa. Such precast concrete walls are generally utilized in place of wall structures and can be stacked onto each other over a few stories.

The concrete body 40 includes footer beam 42, outer shell 44 and upper bond beam 46. The footer beam 42 includes outer surface 50 and inner surface 52. The outer shell includes inner side 57 and outer side 58. The upper bond beam 46 includes outer surface 54 and inner surface 56. A plurality of inner studs 48 span between the footer beam, the outer shell and the upper bond beam at predetermined intervals and at configurations wherein they are substantially parallel to each other. An inner stud facing 60, which may comprise a metal stud member can be molded into the inner stud 48. It will be understood that, preferably, the footer beam, outer shell and upper bond beam, along with the inner studs are integrally formed from a reinforced concrete material, typically in a single integrally molded member, such as a precast concrete member. In some configurations, some of the inner studs, for example, may be added at a later time, or as well as other components may be separately molded from a reinforced concrete. In still other configurations, either the footer beam or the upper bond beam may be eliminated, and the construction may rely on the outer shell with one of the foregoing, or neither of the foregoing, and with or without the inner studs.

The outer shell 44 may define an opening, for, for example, a window, passageway or a door. In such configurations, the opening is bounded by an opening frame 82 which is coupled (typically attached during molding of the concrete) to the concrete body. It will be understood that while the frame may be one shape (i.e., square or rectangular), the opening itself in the concrete may have a different configuration, such that the exposed opening is smaller than the frame. In the example shown, the opening comprises an arched configuration having a portion 62 that overhangs the opening framing. In such a configuration, while a rectangular window can be utilized (which is common and less expensive), the outer appearance from a distance is that of an arched opening and an arched window.

The concrete body 40 spans from upper end 70 to lower end 72 and between first side 74 and second side 76. In the configuration shown, the footer beam 42 extends from the lower end of the concrete body and inwardly from the inner side of the outer shell. Somewhat similarly, the upper bond beam 46 extends from the upper end of the concrete body and inwardly from the inner side of the outer shell. In the configuration shown, while the footer beam is very close to the very end of the lower end, the upper bond beam is spaced apart from the very end of the upper end, creating a fascia region 64 (which can extend over the outer surface 34 of ceiling 14). Such a configuration leads to the upper end of a concrete body on one floor abutting the footer beam of the adjacent floor with only a small seam. The inner studs likewise extend inwardly from the inner side of the outer shell, as well as downwardly from the upper bond beam and up from the footer beam.

It is contemplated that the outer side of the outer shell may have a number of different configurations so as to add an element of design. That is, the outer side may have a configuration that mimics bricks, or that has a trim feature around the openings for the doors, passageways and windows. Additional features may be molded into the outer side for different ornamental or functional reasons. Additionally, features may be coupled to the concrete (that is inserted during molding and hardening of the concrete), such as brackets, braces, numbers or plates, and the like.

An insulation can be integrally formed, or later adhered or applied to the inside surfaces of the concrete body. That is portions of the footer beam, the inner side of the outer shell, the inner studs, the upper bond beam can all have insulation extending thereover. In many instances combinations of different types of insulation are utilized, including extruded polystyrene insulation, foam insulation, blown insulation, fiber based insulation, mineral wool based insulation and the like.

The floor coupling 84 extends from the lower end of the concrete body, and in the configuration shown, extends from the outer surface 50 of the footer beam 42. The floor coupling 84 may comprise a plurality of, for example, metal members that extend from the concrete body, and which are inserted, at least partially, within the concrete body and are accessible therefrom. In the configuration shown, two separate metal bodies extend from, but are coupled to, the concrete body. In other configurations, such a coupling may include further members, and, it is contemplated that other materials may be utilized, such as non-metal members or the like.

Similarly, the ceiling coupling extends from the outer surface 54 of the upper bond beam and, in the configuration shown, comprises a plurality of metal members that extend, at least partially, from the concrete body 40. The particular configuration of the structures can be varied, and different constructions and numbers of members extending from the concrete are contemplated. In the configuration shown, two separate ceiling couplings extend from the concrete body. Again, while the ceiling couplings are contemplated as being of a metal, such as steel, other materials are likewise contemplated for use, such as composites, multi-material members (including metal components) and the like.

It will be understood that, preferably, the floor coupling and the ceiling coupling are inserted during the pouring and/or curing of the concrete body so as to be coupled thereto. It is contemplated, however, that the floor coupling and the ceiling coupling may be attached through fasteners (such as masonry bolts and fasteners) after the concrete body is formed, or that portions may be inserted into the concrete during forming, with further components attached to the portions that were inserted and/or to the concrete.

To assemble the wall assembly, preferably, a form is made for the concrete body. Depending on the configuration, and, optionally, the insulation 80 (or portions thereof), and the inner stud facing 60 can be inserted into the form. Further the opening framing is placed in the form, as are components to form the different features (i.e., such as the openings that may extend through the inner studs for purposes of plumbing or electrical conduit structures).

Further, the ceiling coupling and the floor coupling 86, 84, respectively, are positioned in the form. Furthermore, reinforcing members, such as steel reinforcement or fibers of various types can likewise be placed in the form.

Once the components are placed in the form, the concrete can be poured into the firm. A number of different types of concrete formulations can be utilized. And, it will be understood that the particular configuration of the concrete can be varied depending on the configuration. It will be understood that the form can provide decorative components to the outer side of the outer shell to provide an aesthetic appearance. Additionally, dyes or colorants may likewise be added to the concrete during mixing.

Once the concrete has hardened and the wall assembly is complete, additional insulation may be added, or other structures may be coupled to the wall assembly. For example, additional structures which may define the floor coupling and the ceiling coupling may be added to the wall assembly. Furthermore, other materials such as sealants, colorants, coatings and the like. It will be understood that in some configurations, the outer surface configuration and the type of concrete utilized, as well as the type and preparation of the forms may be such that further processing and treatment to the concrete is not necessary. I other configurations, other than a minor clean-up of the concrete, no further operations are necessary for the concrete body.

It is contemplated that the concrete body may be of varying dimensions, and may have a number of different configurations. For example, the concrete body may be between 8 and 12 feet, in height, or larger. The concrete body may be 2 to 20 feet in length or longer. Additionally, it will be understood that the thickness of the outer shell, the inclusion of a fascia region 64 and/or the thickness of the inner studs can be varied depending on the particular application and the particular location and climate conditions.

To attach the wall assembly to the floors and ceilings of a building, a number of wall assemblies can be provided. In the configuration shown, the floors and ceilings may correspond to a multistory structure wherein the floors and ceilings are formed from a poured concrete construction. As disclosed below, other configurations are contemplated, such as precast floors and ceilings, as well as construction wherein steel beams and girders are utilized.

The wall assembly can be coupled to a hoist or the like and lifted into position relative to the floor and the ceiling. Again, it will be understood that the floor may likewise be the ceiling of the immediately adjacent level, and the ceiling may be the floor of an immediately adjacent level. In other configurations, each level may have a separate floor and ceiling structure.

Once in close proximity, the wall assembly is directed so that the floor coupling member 84 is positioned in the proper orientation relative to the floor coupling member 26 of the floor 12. At the same time, the wall assembly is directed so that the ceiling coupling 86 is positioned in the proper orientation relative to the ceiling coupling member 86. Once the proper positions are confirmed, the structures are coupled together in secured retention. For example, in some configurations, the floor coupling 84 and the floor coupling member 26 can be welded together. Similarly, the ceiling coupling 86 an the ceiling coupling member 36 can be welded together. As such, the wall assembly is permanently coupled to the floor and ceiling that are adjacent to each other. It is contemplated that in certain configurations, the wall assembly can be of sufficient height to extend between two adjacent levels, coupling to the floor of the first level and to the ceiling on the second level.

In the configuration shown, the wall assembly spans only a single level, and, the fascia region 64 extends over the outer surface 34 of the ceiling 14. Additional wall assemblies are positioned as necessary and installed. As the different wall assemblies are substantially independent of each other, there is not necessarily a required sequence for the coupling of the wall assemblies onto the respective floors and ceilings. A number of different patterns can be followed.

Once completed and the wall assembly, or multiple wall assemblies are attached to the respective floors and ceilings, the user can insert a sealant, structure, insulation and the like 90 between adjacent wall assemblies. That is, such materials and processes may be done between the upper end of one wall assembly and the lower end of an adjacent wall assembly or the floor and/or ceiling where no adjacent wall assembly is present. Additionally, such structures and processes may be done between adjacent first and second sides of adjacent wall assemblies.

Either prior to attachment of the wall assembly, or thereafter, windows, doors, and other structures can be coupled to the opening framing. For example, such structures can be coupled, in many manners, most all of which are known to one of ordinary skill in the art, to the opening framing. In the configuration shown, a generally rectangular window is placed into and coupled to the opening framing. However, due to the overhanging structures formed in the concrete body, from the outside, the window appears to be in a configuration that is arched, again, due to the overhanging portions 62. In other configurations, ornate configurations may overhang changing the outer appearance of the window, door or other structure placed into and coupled to the opening framing. Advantageously, the user can provide a rectangular window, which is not only cheaper and which may have more utility (opening, venting, etc.) while providing an appearance of an ornately designed window. This may be accomplished with particular window configurations, such as square windows, that, due to the overhanging portion 62 have a circular appearance.

Advantageously, the wall assembly can be used for a multistory building, whereas it is generally intended for use in a stackable configuration. That is, stackable only to a couple to a few stories. There is not a practical limitation as to the height of the buildings to which the outer building construction can be applied. This is because, the wall assemblies are not coupled to each other in a stacked configuration, but, rather attached independently to the floors and ceilings of the structure (it is contemplated that in some configurations, one or more wall assemblies can be stacked, then coupled to floors and ceilings, in a hybrid configuration. Nevertheless, in the stacked configuration, the stacked height is substantially limited, as the wall assemblies lack the necessary strength to be stacked, for example, 6 or 7 high, or higher. Furthermore, such a construction provides a fully completed and developed wall assembly that is ready for electrical conduit, plumbing and a covering such as drywall, which may be directly coupled to the inner stud facing 60. In some configuraitons, it may not even be necessary to provide additional insulation or the like. Furthermore, in many configurations, it is not necessary to apply a finish (such as stucco, paint, siding, fascia, cladding or the like to the outer side of the outer shell of the wall assembly. The wall assembly concrete material itself is fully finished when molded. Furthermore, due to the form nature of the wall assembly, it is contemplated that the different floors may have different dimensions and the like, and may include different features. In such a configuration, multiple forms may be developed to produce a number of different configurations. In other structures, most all of the wall assemblies can be of substantially identical configuration, wherein a plurality of these are sequentially, or simultaneously installed on the building. It is further contemplated that the wall assemblies may be utilized for internal walls, such as hallways, and partially exposed or inwardly facing wall structures (in, for example, atriums and the like).

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A building construction comprising:

a floor having an upper surface and an outer surface, one of the upper surface and the outer surface having a floor coupling member positioned thereon;

a ceiling having a lower surface and an outer surface, one of the lower surface and the outer surface having a ceiling coupling member positioned thereon;

an insulation; and a wall assembly comprising:

a concrete body having a footer beam, an outer shell and an upper bond beam, the concrete body being structured from a precast concrete member and including a fascia region that extends over the outer surface of the ceiling;

a floor coupling positioned on the footer beam or a lower end of the outer shell; and a ceiling coupling positioned on the upper bond beam or an upper end of the outer shell;

wherein, the floor coupling of the concrete body is attached to the floor coupling member of the floor, the ceiling coupling of the concrete body is attached to the ceiling coupling member of the ceiling, to, in turn, attach the wall assembly to the floor and the ceiling, the floor coupling leaving a first space between the floor and the footer beam, the ceiling coupling leaving a second space directly between the ceiling and the upper bond beam, and the floor coupling and the ceiling coupling leaving a third space between the concrete body and ends of both the floor and the ceiling, wherein the insulation is disposed within the first space, the second space, and the third space.

2. The building construction of claim 1 wherein the floor coupling member comprises at least one metal member that is coupled to the floor.

3. The building construction of claim 2 wherein the ceiling coupling member comprises at least one metal member that is coupled to the floor.

4. The building construction of claim 3 wherein the floor coupling of the concrete body and the ceiling coupling of the concrete body comprise at least one metal member corresponding, respectively, to the floor coupling member and the ceiling coupling member.

5. The building construction of claim 4 wherein the at least one metal member of the floor coupling and the at least one metal member of the floor are welded together, and wherein the at least one metal member of the ceiling coupling and the at least one metal member of the ceiling are welded together.

6. The building construction of claim 5 wherein the concrete body further includes a plurality of inner studs extending from at least one of the outer shell, the footer beam and the upper bond beam, the inner studs being spaced apart from each other.

7. The building construction of claim 6 wherein the plurality of inner studs span between the outer shell, the footer beam, and the upper bond beam, and further include an inner stud facing formed coupled thereto.

8. The building construction of claim 7 wherein the inner stud facing comprises a metal member that is coupled to the concrete body, and extending therefrom.

9. The building construction of claim 4 wherein the at least one metal member of the floor coupling extends from the concrete body, and the at least one metal member of the ceiling coupling extends from the concrete body, with the concrete body being molded therearound.

10. The building construction of claim 9 wherein the at least one metal member of the floor coupling comprises at least two spaced apart metal members, and the at least one metal member of the ceiling coupling comprises at least two spaced apart members.

11. The building construction of claim 1 wherein the floor coupling member extends from the upper surface of the floor.

12. The building construction of claim 11 wherein the ceiling coupling member extends from the lower surface of the ceiling.

13. The building construction of claim 1 wherein the wall assembly further includes a plurality of openings defined in the outer shell of the concrete body, and further including an opening framing coupled to the concrete body.

14. The building construction of claim 13 wherein the concrete body further includes an overhanging portion on an outer side of the outer shell that extends into the opening framing, so as to change an outward appearance of the opening framing.

* * * * *